US005532794A

United States Patent [19]

Tokuyama et al.

[11] Patent Number: 5,532,794

[45] Date of Patent: Jul. 2, 1996

[54] ELECTROPHOTOGRAPHIC IMAGE STABILIZATION CONTROL APPARATUS

[75] Inventors: Mitsuru Tokuyama, Nara; Toshiaki Ino; Motoyuki Itoyama, both of Yamatokoriyama; Kunio Ohashi; Haruo Nishiyama, both of Nara, all of Japan

[73] Assignee: Sharp Kabushiki Kaisha, Osaka, Japan

[21] Appl. No.: 175,636

[22] Filed: Dec. 30, 1993

[30] Foreign Application Priority Data

Jan. 7, 1993 [JP] Japan ..... 5-001384

[51] Int. Cl.[6] ..... G03G 21/00

[52] U.S. Cl. ..... 355/208; 355/219; 355/246

[58] Field of Search ..... 355/208, 246, 355/216, 219, 214, 203, 233

[56] References Cited

U.S. PATENT DOCUMENTS

| | | | |
|---|---|---|---|
| 4,684,243 | 8/1987 | Minor | 355/317 |
| 5,072,258 | 12/1991 | Harada | 355/208 |
| 5,170,210 | 12/1992 | Saruwatari | 355/208 |
| 5,253,018 | 10/1993 | Takeuchi et al. | 355/203 |
| 5,276,483 | 1/1994 | Hasegawa et al. | 355/208 |
| 5,307,119 | 4/1994 | Folkins et al. | 355/246 X |
| 5,400,120 | 3/1995 | Narazaki et al. | 355/208 |

FOREIGN PATENT DOCUMENTS

| | | |
|---|---|---|
| 0384493 | 8/1990 | European Pat. Off. . |
| 0443535A2 | 8/1991 | European Pat. Off. . |
| 0520144A2 | 12/1992 | European Pat. Off. . |
| 55-55349 | 4/1980 | Japan . |
| 55-127572 | 10/1980 | Japan . |
| 58-123567 | 7/1983 | Japan . |
| 58-122571 | 7/1983 | Japan . |
| 58-152273 | 9/1983 | Japan . |
| 58-136061 | 12/1983 | Japan . |
| 3-215051 | 9/1991 | Japan . |
| 4-267269 | 9/1992 | Japan . |
| 4-165371 | 11/1992 | Japan . |

*Primary Examiner*—Arthur T. Grimley
*Assistant Examiner*—Shuk Y. Lee
*Attorney, Agent, or Firm*—David G. Conlin; Brian L. Michaelis

[57] ABSTRACT

A process control apparatus of electrophotographic apparatus has an optical sensor for optically detecting the density of toner patches formed on a photoreceptor drum. The present apparatus is further provided with a control device for controlling lamps for the copying process, chargers and other elements. A toner patch is formed on the photoreceptor so as to be located between every two toner images for a copying operation. The control device controls the lamps, chargers and other elements in accordance with the result of the toner patches detected by the optical sensor so as to stabilize the copying picture quality. With the arrangement, it is avoided that the job efficiency during the copying operation deteriorates, and the control data obtained from the toner patches is soon used for the toner image formation for the copying operation, thereby ensuring that the process control improves in accuracy.

20 Claims, 15 Drawing Sheets

450V
350V
250V
0V
ON

OFF

OFF
400V 200V
0V

ELECTROPHOTOGRAPHIC IMAGE STABILIZATION CONTROL APPARATUS

FIELD OF THE INVENTION

The present invention relates to a process control apparatus of electrophotographic apparatus which controls each section of an electrophotographic process in accordance with the density of a reference toner image so as to obtain a stably formed picture image.

BACKGROUND OF THE INVENTION

In an electrophotographic apparatus such as a copying machine and laser printer, it sometimes happens that the surface potential of a photoreceptor greatly changes according to the environmental change such as a temperature change. For instance, when the photoreceptor has an OPC (Organic Photoconductive Conductor), since the mobility of optical carriers has the temperature dependency, the surface potential drops down by about 100 V under a low temperature circumstance compared to that of the normal temperatures, thereby causing the occurrence of a residual potential. Therefore, the toners moved to white parts of the copying picture image, thereby causing the fog.

There is the following tendency. More specifically, when the copying and printing operations are repeatedly carried out, a mechanical stress such as polishing due to a cleaning blade is accumulated so as to reduce the film thickness of the photoreceptor layer, thereby resulting in that the surface potential gradually drops. The occurrence of such change in the surface potential gives a great affection such as lowering of the density on the picture quality of formed picture image.

In contrast, the developer sensitive to a humidity change because of its powder. In general, when it is low humidity, the developer has a high electrical resistance, thereby resulting in that the frictionally charged toner has a strong charge holding capability. As a result, the charged amount of the toner increases, thereby changing the picture quality. Additionally, the developer deteriorates due to the repeated using thereof, thereby causing the great change of the picture quality.

In order to compensate the foregoing deficiencies, the conventional electrophotographic apparatus stabilizes the picture quality by measuring the electrostatic latent image formed on the photoreceptor so as to control the forming of electrostatic latent image in accordance with the measured results (see, for example, the Japanese examined patent publication No. 61-29502/1986).

There is another example which compensates the foregoing deficiencies. Such example is provided with means for detecting the optical density of the toner image on the photoreceptor so as to detect the change of quality and control the electrophotographic process in accordance with the detected results, so that the optimum picture quality can be obtained according to the example, a plurality of square toner patches of about 30 mm×30 mm as the toner image are provided on the photoreceptor so that each toner patch has a different density from other toner patches, thereby individually detecting the optical density thereof.

The following description deals with the process of detection of the optical density in accordance with the formation of the toner patches with reference to a time chart of FIGS. 15(*a*) through 15(*f*). The drum-type photoreceptor is charged on respective different positions by different grid voltages −500 V, −400 V, and −300 V in this order (see FIG. 15(*a*)).

A copy lamp is turned off with respect to the charged area, so that the, exposure operation is not carried out (see FIG. 15(*b*)), and during the period a blank lamp is as shown in FIG. 15(*c*).

Therefore, electrical charges due to the grid voltages remain in the charged area as they are. Three toner patches (see FIG. 15(*e*)) having different density are formed by developing the charged area with a constant developing bias voltage of −200 V (see FIG. 15(*b*)), and each density of the toner patches is detected by an optical sensor in accordance with the detecting timing of FIG. 15(*f*). Thereafter, the grid voltages, the developing bias voltage, and other factors are controlled in accordance with each detected density of the toner patches so as to correct the picture quality.

After the control, the photoreceptor is charged by a constant grid voltage of −700 V. Then, the charged area of the photoreceptor is exposed by the copy lamp having respective applying voltages 60 V, 65 V, and 70 V. Three toner patches having different density are formed by developing the charged area with a constant developing bias voltage of −200 V, and each density of the toner patches is detected by an optical sensor in the foregoing manner. Then, the applying voltage of the copy lamp is controlled so as to correct the picture quality.

Note that it requires about 2 seconds to control the process in accordance with the detected optical density of the six toner patches upon formation of the toner patches. Accordingly, the process control based on the toner patches is carried out before and after (1) the turn-on operation of the main power of the copying machine and (2) the copying operation, so as not to bring any troubles during the copying operation.

However, the timing of process control based on the toner patches is only made during the turn-on operation of the main power of the copying machine. So, since the change of circumstances such as the temperature rise of 10° C. to 15° C. inside the copying machine occurs until performing the copying operation, the conventional apparatus presents the problem that the accuracy of the process control deteriorates.

In order to avoid the foregoing problem, when the timing is made before the copying operation, the job efficiency during the copying operation is reduced, thereby resulting in that the claims of its market. In contrast, when the timing is made after the copying operation, the density correction of picture image is not carried out until the copying operation finishes, thereby presenting the problem, which is similar to the case where the timing is made on the power-on, that the accuracy of the process control deteriorates.

SUMMARY OF THE INVENTION

The present invention is achieved in light of the foregoing deficiency. It is an object of the present invention to provide a process control apparatus of electrophotographic apparatus which can optimize a picture image formation with improvement in accuracy of the process control and without deteriorating of the job efficiency.

In order to achieve the foregoing object, the present invention has:

density detecting means for optically detecting density of a reference toner image on a photoreceptor;

means for judging whether or not the density detecting means has detected the density by a predetermined number of times; and information processing means for forming a reference toner image between every two toner images for a picture image formation, and for controlling each section of an electrophotographic process in response to the judging means so as to stabilize picture quality of a formed picture image.

With the arrangement, the information processing means forms each reference image between every two toner images for the picture image, and controls each section of the electrophotographic process upon receipt of a plurality of detected results from the density detecting means. The process control is carried out by making use of the period of time between every two toner image formations for the picture image formation, it can be avoided that the job efficiency deteriorates. Since the control data obtained from the reference toner image is soon used for the toner image formation for the picture image, the process control improves in accuracy, thereby enabling to optimize the picture image formation.

The information processing means is arranged so as to stepwise control a degree of an exposure during controlling each section of the electrophotographic process, thereby obtaining an optimum exposure state. In a case where each section of the electrophotographic process is controlled when a plurality of toner images for the picture image are formed, it is preferable that the information processing means is arranged so as to stepwise control. In such case, according to the stepwise control, the great change in the picture quality during the picture image formations can be avoided. So, the process control improves in accuracy.

In order to achieve the foregoing object, another process control apparatus of electrophotographic apparatus in accordance with the present invention has:

density detecting means for optically detecting density of a reference toner image on a photoreceptor;

temperature detecting means for detecting a temperature inside the electrophotographic apparatus; and means for judging whether or not a temperature difference between a temperature currently detected by the temperature detecting means and a detected temperature during controlling of each section of a previous electrophotographic process becomes not less than a predetermined temperature difference.

control means for controlling again each section of the electrophotographic process so as to stabilize a picture quality of a formed picture image when the temperature difference is not less than the predetermined temperature difference.

With the arrangement, it is judged whether or not the temperature difference between the temperature currently detected by the temperature detecting means and the detected temperature during controlling of each section of the previous electrophotographic process becomes not less than the predetermined temperature difference, and if not less than the predetermined temperature difference, each section of the electrophotographic process is again controlled. So, the process control is carried out in accordance with the temperature change inside the electrophotographic apparatus.

So, the picture quality change which generated by the sensitivity change due to the temperature change such as the sensitivity change of the photoreceptor is reduced, thereby avoiding the great change of picture quality. Additionally, the present arrangement can carry out the process control with less frequency though the conventional arrangement frequently carried out in order to avoid the above-mentioned great change of the picture quality.

Accordingly, it can be avoided that the toner amount consumed by the toner patch method during the process control becomes great, the process control improves in accuracy, and the optimization of the picture image formation can be achieved.

In order to achieve the foregoing object, still another process control apparatus of electrophotographic apparatus in accordance with the present invention has:

density detecting means for optically detecting density of a reference toner image on a photoreceptor, and for outputting as a detected result a value, which is obtained by dividing detected density of the reference toner image by detected density of a photoreceptor base; and developing bias voltage control means for changing a developing bias voltage, which prevents a toner from being attracted by a residual electric potential of a bright section on the photoreceptor which is generated after an exposure operation, so as to be different from that of during detecting of the density of the reference toner image when the density detecting means detects the density of the photoreceptor base, whereby the density of the reference toner image is accurately detected and a picture quality correction is carried out in accordance with the detected result.

Under the low temperature circumstance, there happens that the residual electric potential of the bright section after the exposure operation is induced to be great, the induced residual electric potential causes the toner to adhere to the photoreceptor, thereby presenting the tendency that the high density of the photoreceptor base is detected. However, with the arrangement, when the density detecting means detects the density of the photoreceptor base, the developing bias voltage control means controls so as to change (for example, increase) the developing bias voltage such that the toner attraction in the portion of the residual electric potential of the bright section is avoided more than during detecting of the density of the reference toner image.

Since the changed developing bias voltage erases the residual electric potential of the photoreceptor, it is possible to detect the density of the photoreceptor base with adhering of almost no toner to the photoreceptor. So, since the detected density of the photoreceptor base is calculated with accuracy, the output from the density detecting means becomes accurate, thereby ensuring that the process control improves in accuracy.

In order to achieve the foregoing object, another process control apparatus of electrophotographic apparatus in accordance with the present invention has:

density detecting means for optically detecting density of a reference toner image on a photoreceptor;

temperature detecting means for detecting a temperature inside the electrophotographic apparatus; and means for comparing (1) a temperature difference between a temperature currently detected by the temperature detecting means and a detected temperature during controlling of each section of a previous electrophotographic process with (2) a set reference temperature difference;

reference temperature changing means for changing the reference temperature difference in response to the temperature detecting means;

control means for controlling again each section of the electrophotographic process so as to stabilize a picture quality of a formed picture image when the detected temperature difference is not less than the reference temperature difference.

With the arrangement, since (1) the sensitivity of the photoreceptor drum becomes worse under the low temperature circumstance, while becomes better in accordance with the temperature rise, and (2) the changing rate of the improving sensitivity due to the temperature rise becomes small as the temperature rises, the reference temperature changing means ensures that the process control is carried out in accordance with the sensitivity change of the photoreceptor due to the temperature change.

More specifically, since the sensitivity change of the photoreceptor drum due to the temperature rise is great under the low temperature circumstance, the the process control can be frequently executed by setting the reference temperature difference small, while, under the ordinary temperatures, since the sensitivity change of the photoreceptor drum due to the temperature rise is small, the process control can not be frequently executed by setting the reference temperature difference great.

Though the sensitivity change of the photoreceptor drum due to the temperature rise inside the copying machine is small, the unnecessary execution of the process control, which is carried out when the temperature change inside the copying machine is more than the predetermined value, can be omitted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

DESCRIPTION OF THE EMBODIMENTS

The following description describes the first embodiment of the present invention wherein a process control apparatus is adapted to a copying machine with reference to FIGS. 1 through 5.

Figure 1A:
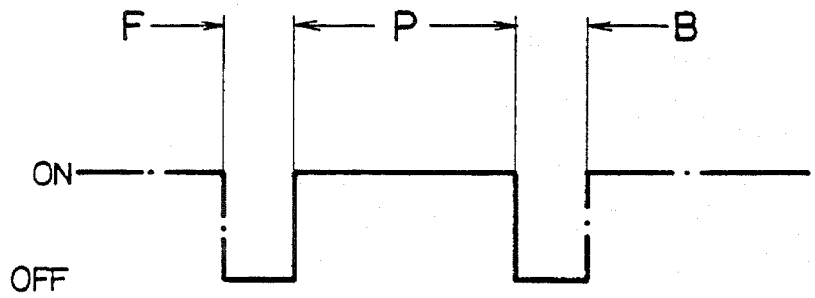
FIGS. 1(*a*), 1(*b*), 1(*c*), 1(*d*), 1(*e*), and 1(*f*) are time charts showing respectively time charts of a process control for charged potentials in a copying machine having a process control apparatus of one embodiment in accordance with the present invention.
Figure 1B:
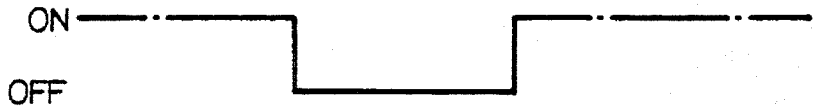
Figure 1C:
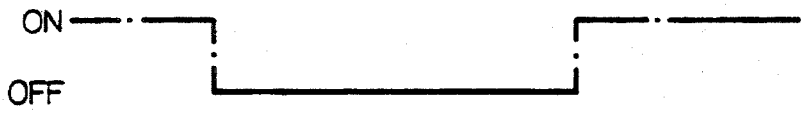
Figure 1D:
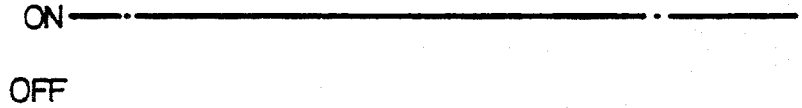
Figure 1E:
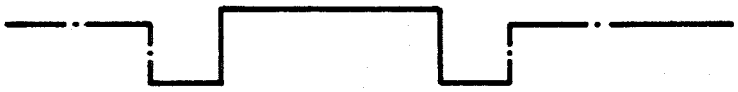
Figure 1F:
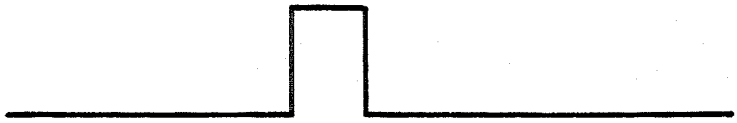
Figure 2A:
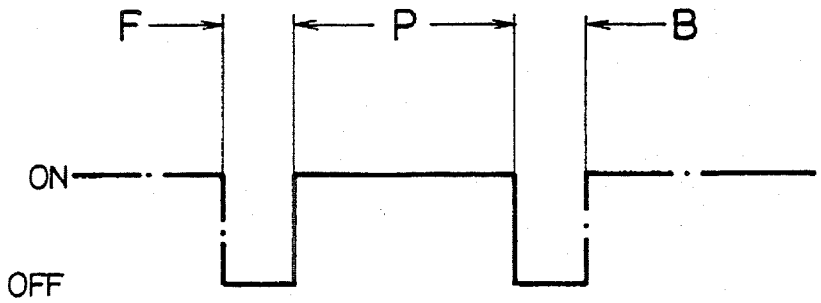
FIGS. 2(*a*), 2(*b*), 2(*c*), 2(*d*) 2(*e*), and 2(*f*) are time charts showing respectively a process control for a copy lamp in copying machine having the process control apparatus.
Figure 2B:
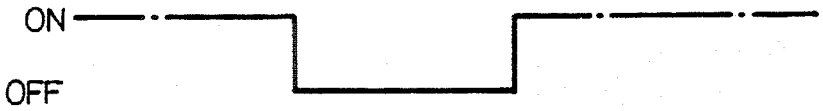
Figure 2C:
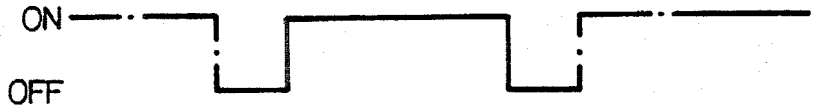
Figure 2D:
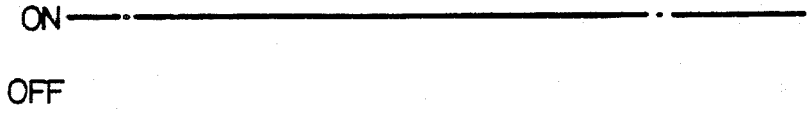
Figure 2E:
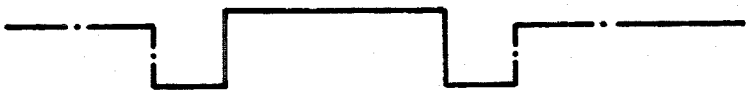
Figure 2F:
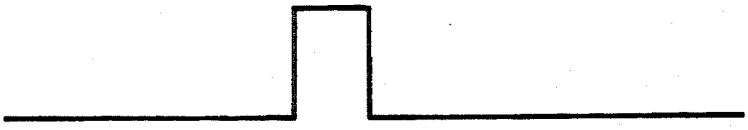
Figure 3:
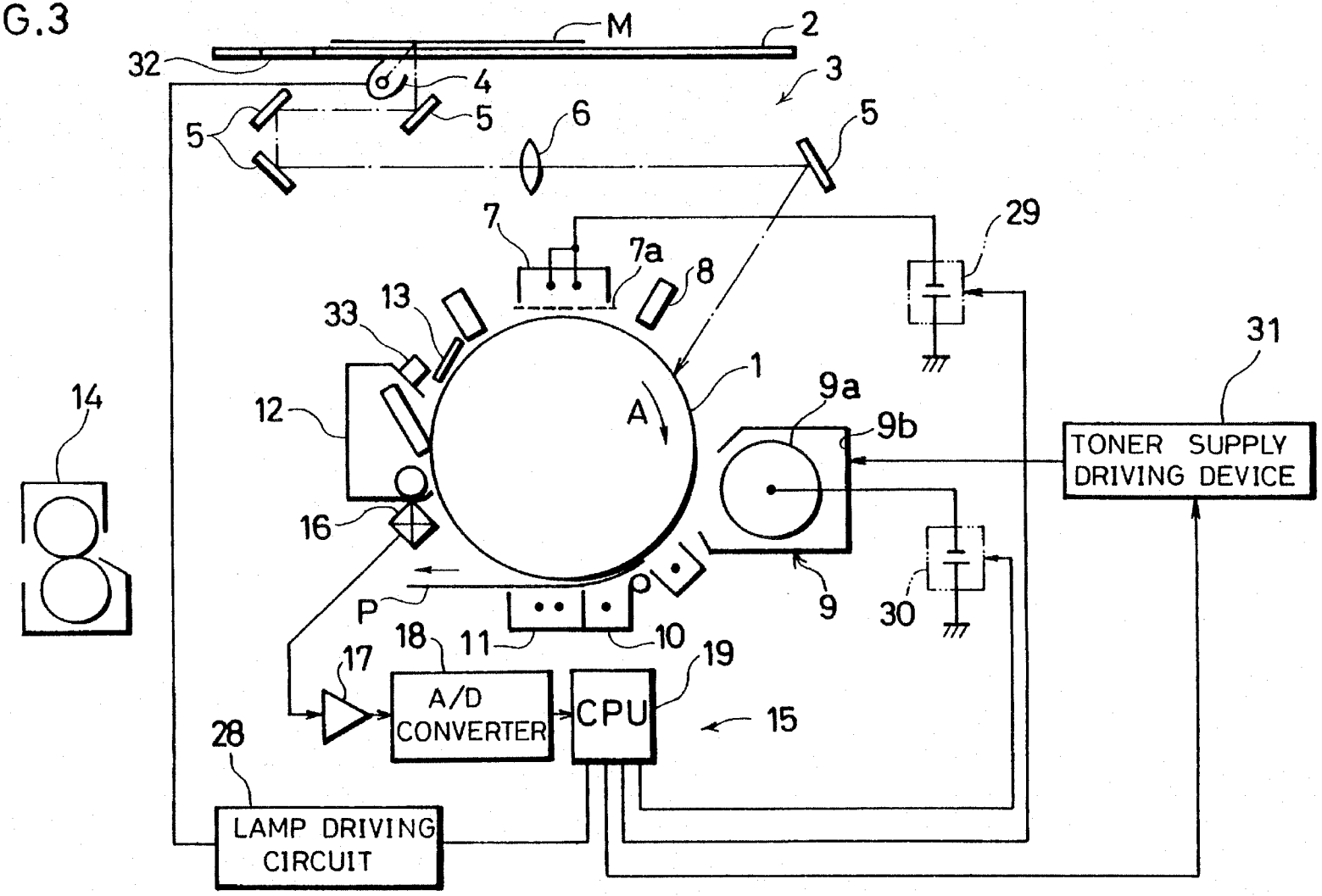
FIG. 3 is a schematic explanatory diagram showing the structure of a copying machine having the process control apparatus.
Figure 4A:
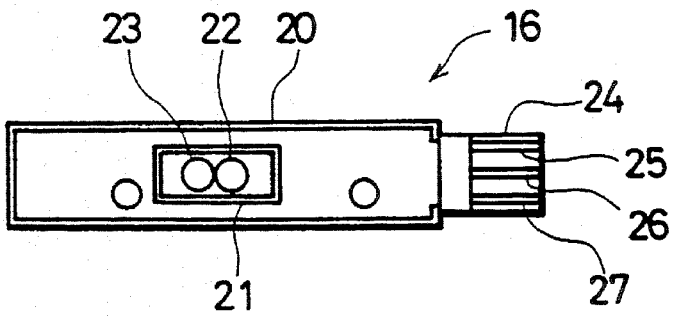
FIGS. 4(*a*), 4(*b*), and 4(*c*) show the structure of an optical sensor of the copying machine, FIG. 4(*a*) is a plan view, FIG. 4 (*b*) is a front view, and FIG. 4(*c*) is a side view.
Figure 4B:
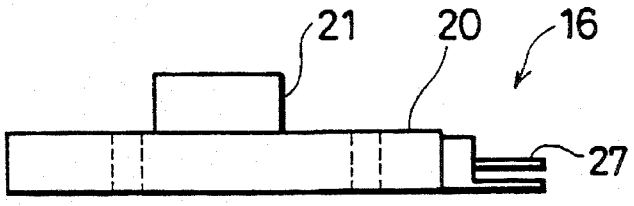
Figure 4C:
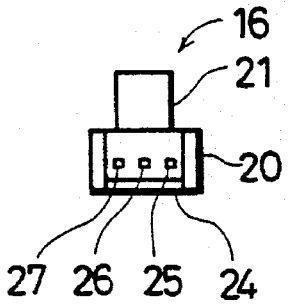

A copying machine in accordance with the present embodiment is provided with a photoreceptor drum 1 having a shape of cylindrical as a photoreceptor (see FIG. 3). The photoreceptor drum 1 is rotatably provided in a direction A in the copying machine. For example, the photoreceptor drum 1 has a drum base as a photoreceptor base made of an aluminum pipe having a pipe thickness of about 2 mm, a diameter of about 100 mm, and a length of about 340 mm, and an outer peripheral surface of the drum base is uniformly coated with an electrical charge generating layer having a thickness of 1 micron (μm) and an electrical charge transporting layer having a thickness of 34 micron in this order so as to form an organic semiconductor.

A document place plate 2 of transparent for placing a document M thereon is provided above the photoreceptor drum 1. An exposure optical system 3 is provided between the document place plate 2 and the photoreceptor drum 1. The exposure optical system 3 is composed of a copy lamp 4, a plurality of mirrors 5, and a lens 6.

The exposure optical system 3 carries out an optical scanning of the document M in accordance with the light projected from the copy lamp 4 (see the alternate long and short dash line of FIG. 3) by moving the document place plate 2, and directs the light to the surface of the photorecetpor drum 1 through the mirrors 5 and lens 6 so as to carry out the exposure operation. According to the exposure, an electrostatic latent image is formed in accordance with a picture image pattern of the document M on the surface of the photoreceptor drum 1 which is uniformly charged by a main charger 7 (described later).

There is provided around the photoreceptor drum 1 the main charger 7, a blank lamp 8, a developing unit 9, a transfer charger 10, a separating charger 11, a cleaner unit 12, an erase lamp 13, and other elements.

The main charger 7 is a charging device for charging the surface of the photoreceptor drum 1 by a target electric potential in accordance with the controlling of a voltage i.e., a grid voltage, applied to a grid electrode 7*a* which is provided between the photoreceptor drum 1 and the main charger 7. The blank lamp 8 is an erase device for out the erasing by exposing an area with no picture image on the surface of the photoreceptor drum 1. The developing unit 9 is a developing device for visualizing the latent image as the toner image by attaching the toner to the latent image formed on the surface of the photoreceptor drum 1.

The transfer charger 10 supplies an electric potential onto the surface of the photoreceptor drum 1 so as to transfer the toner image formed on the surface of the photoreceptor drum 1 to a transfer sheet P. The separating charger 11 supplies an electric potential onto the surface of the photoreceptor drum 1 so as to separate the transfer sheet P, to which the toner image is transferred, from the photoreceptor drum 1. The cleaner unit 12 is a cleaning device for recovering the residual toners on the surface of the photoreceptor drum 1. The erase lamp 13 is an erase device for erasing the residual electric charges on the surface of the photoreceptor drum 1 before the main charger 13 charges the photoreceptor drum 1. A fusing unit 14 is provided on a discharge side of the present copying machine. The fusing unit 14 fixes with heat the toner image onto the transfer sheet P which is separated from the photoreceptor drum 1 and is fed by a feeder (not shown).

The present copying machine is provided with a process control section 15 for controlling each section of the electrophotographic process. The process control section 15 is composed of an optical sensor 16 as density detecting means for detecting the density of the outer peripheral surface of the photoreceptor drum 1, a standard white plate 32 which is provided on a starting end side of the document place plate 2, an amplifier 17, an A/D converter 18, and a CPU 19, so as to control a copying process section composed of the photoreceptor drum 1 and other devices.

The optical sensor 16 is a detecting device which is provided in the vicinity of a lower side the cleaner unit 12. The optical sensor 16 projects the light such as the infrared light rays direct toward the surface of the photoreceptor drum 1 and receives the reflected light by use of a photo-transister or other device. Thus, the optical sensor 16 detects the optical density of the toner patch as a reference toner image formed on the surface of the photoreceptor drum 1, and outputs the detected result as a detected signal.

More specifically, the optical sensor 16 has an outline made by a case 20 of a long thin. An attaching section 21 is provided so as to project in the near center section of an outer surface of the case 20 (see FIGS. 4(*a*) through 4(*c*)).

The attaching section 21 is provided with an infrared light generating diode 22 for projecting the light having a wavelength of 890 nm and a photo-transister 23, the elements 22 and 23 being located close with each other. One end side of the case 20 is provided with a terminal section 24 which is provided like a connector. The terminal section 24 is provided with a power source terminal 25, an output terminal 26, and a GND terminal 27 in a predetermined interval.

The optical sensor 16 is connected with the CPU 19 through the amplifier 17 and A/D converter 18 (see FIG. 3). The detected signal of the optical sensor 16 is amplified by the amplifier 17, and thereafter is converted into a binary signal by the A/D converter 18 so as to output the binary signal as a density data to the CPU 19.

The CPU 19 is respectively connected with a lamp driving circuit 28, a power source 29, a developing bias power source 30, and a toner supply driving device 31. The lamp driving circuit 28 is a power source for lighting the copy lamp 4.

The power source 29 is a power source for generating the grid voltage which is supplied to the grid electrode 7*a* of the main charger 7. The developing bias power source 30 is a power source for generating the developing voltage which is supplied to a developing sleeve 9*a* of the developing unit 9. The toner supply driving device 31 is a device for supplying the toner from a toner hopper (not shown) to a developing vessel 9*b*.

Note that the developing bias is supplied in order to avoid that the residual electric potential of the bright section, which is about −80 V to −100 V and is generated after the surface of the photoreceptor drum 1 has been exposed by supplying the bias to the developing sleeve 9*a*, attracts the toner.

The CPU 19 outputs control signals to the lamp driving circuit 28, power source 29, developing bias power source 30, and toner supply driving device 31 so that the optimum control lings are carried out with respect to the lamp supplying voltage, grid voltage, developing voltage, and the toner supplying amount to the developing vessel 9*b* respectively.

More specifically, the CPU 19 executes a program for forming the toner patches, thereby making totally six toner patches. In the formation of the toner patches, each toner patch is supplied by a different grid voltage of the grid electrode 7*a* a and a different voltage applied to the copy lamp 4, thereby causing the charging voltages or surface electric potentials of the photoreceptor drum 1 to be different from each other. Thus, each toner patch having a different toner density to be visualized is obtained.

The CPU 19 forms a toner patch between every two toner images, the copying operation being carried out in accordance with the plurality of toner images, and has a function of information processing means by which each section of the copying processes is controlled upon receipt of a plurality of detected results from the optical sensor 16.

Further, the CPU 19 controls a timer (not shown) so as to start counting of time which is used for making a timing of sampling the detection of the toner patches (described later) when the blank lamp 8 is turned off.

When each section of the copying processes is controlled during the copying operation, there sometimes happens that each controlling value of the processes such as the voltage applied to the copy lamp 4 greatly changes. In such case, however, the CPU 19 carries out stepwise controlling of each section of the copying processes so as to stepwise change the controlling value one after the other. Note that the stepwise controlling is carried out when the change becomes greater than a predetermined value which is preliminarily set.

The following description deals with the process control of the copying machine having the above-mentioned arrangement.

The present embodiment is arranged such that each toner patch is formed by making use of the period of time between the copying operations. More specifically, as shown in the time chart of FIGS. 1(*a*) through 1(*f*), a toner patch forming section P for forming one toner patch on the photoreceptor drum 1 is provided between copying picture image forming sections F and B.

In the formation of the toner patches, the main charger 7 charges the photoreceptor drum 1 by a grid voltage of −500

V for example during the period of time between (1) the time when a toner image is formed on the first copying picture image forming section F in accordance with the first copying operation and (2) the time when the toner image is formed on the second copying picture image forming section B in accordance with the second copying operation. During the charging, the blank lamp 8 (see FIG. 1(*b*)) is turned off as soon as the grid voltage (see FIG. 1(*a*)) is turned on, and is kept turning off until the end of the toner patch forming section so as not to project the light. The copy lamp 4 (see FIG. 1(*c*)) is not turned on during the formation of the first three toner patches.

According to the foregoing operations, the toner patch forming section P of the charged photoreceptor drum 1 becomes a latent image having the electrical charge amount varying depending on the grid voltage.

When the latent image is developed with applying a constant developing bias voltage of −200 V (see FIG. 1(*d*)), a toner image as the toner patch is obtained. In the detection of the toner patch density (see FIG. 1(*e*)), the blank lamp 8 is turned off, and simultaneously the timer (not shown) is operated so that the sampling for the detection of the optical sensor 16 is carried out with respect to the first toner patch after the time elapsing of 50 ms (mill-second) for example (see FIG. 1(*f*)).

With respect to the second and third toner patch forming sections, the respective grid voltages −400 V and −300 V are applied and other conditions are the same as the foregoing ones, thereby forming the second and third toner patches. The samplings are carried out after the timer counts the respective predetermined time elapsings, the timer starting to count when the blank lamp 8 is turned off. Accordingly, the density detections of the toner patches are carried out when it reaches the intermediate section of the output of the optical sensor where the optical sensor 16 can stably output.

Then, after obtaining the detected data of the three toner patches having different density, the grid voltage, developing bias voltage and the like are controlled in accordance with the respective detected toner patches density so as to correct the picture quality.

When the picture quality correction is completed in accordance with the controllings of developing bias voltage and other factors, the voltage applied to the copy lamp 4 is controlled. During the controlling of the voltage applied to the copy lamp 4, another three toner patches are formed. Each toner patch is formed by making use of the period of time between the copying operations (see the time chart of FIGS. 2(*a*) through 2(*f*)).

In the formation of the toner patches, the main charger 7 charges the photoreceptor drum 1 by a grid voltage of −700 V during the period of time between (1) the time when the toner image is formed on the copying picture image forming section F in accordance with the fourth copying operation and (2) the time when the toner image is formed on the copying picture image forming section B in accordance with the fifth copying operation.

During the charging, the blank lamp 8 (see FIG. 2(*b*)) is turned off as soon as the grid voltage (see FIG. 2(*a*)) is turned on, and is kept turning off until the end of the toner patch forming section so as not to project the erasing light. The copy lamp 4 (see FIG. 2(*c*)) is turned on while being applied by 60 V. The reflected light from the standard white plate 32 in accordance with the copy lamp 4 exposes the photoreceptor drum 1.

According to the foregoing operations, the toner patch forming section P of the charged photoreceptor drum 1 becomes a latent image having the surface electric potential corresponding to the difference between the electrical charge amount corresponding to the grid voltage and the electrical charge amount erased by the copy lamp 4 exposure. When the latent image is developed by the constant developing bias voltage of −200 V (see FIG. 2(*d*)), a toner image as the toner patch is obtained.

In the detection of the toner patch density (see FIG. 2(*e*)), the blank lamp 8 is turned off, and simultaneously the timer (not shown) is operated so that the sampling for the detection of the optical sensor 16 is carried out with respect to the fourth toner patch after elapsing the time of 50 ms for example (see FIG. 2(*f*)).

With respect to the fifth and sixth toner patch forming sections, the respective voltages applied to the copy lamp 4 65 V and 70 V are applied and other conditions are the same as the foregoing ones, thereby forming the fifth and sixth toner patches having different density. The samplings are carried out after the timer counts the respective predetermined time elapsings, the timer starting to count when the blank lamp 8 is turned off.

The picture quality correction is carried out after obtaining the detected data of the three toner patches having respective different density so that the picture quality is corrected by adjusting the voltage applied to the copy lamp 4.

The above-mentioned picture quality correction is stepwise and divisionally carried out.

Figure 5:
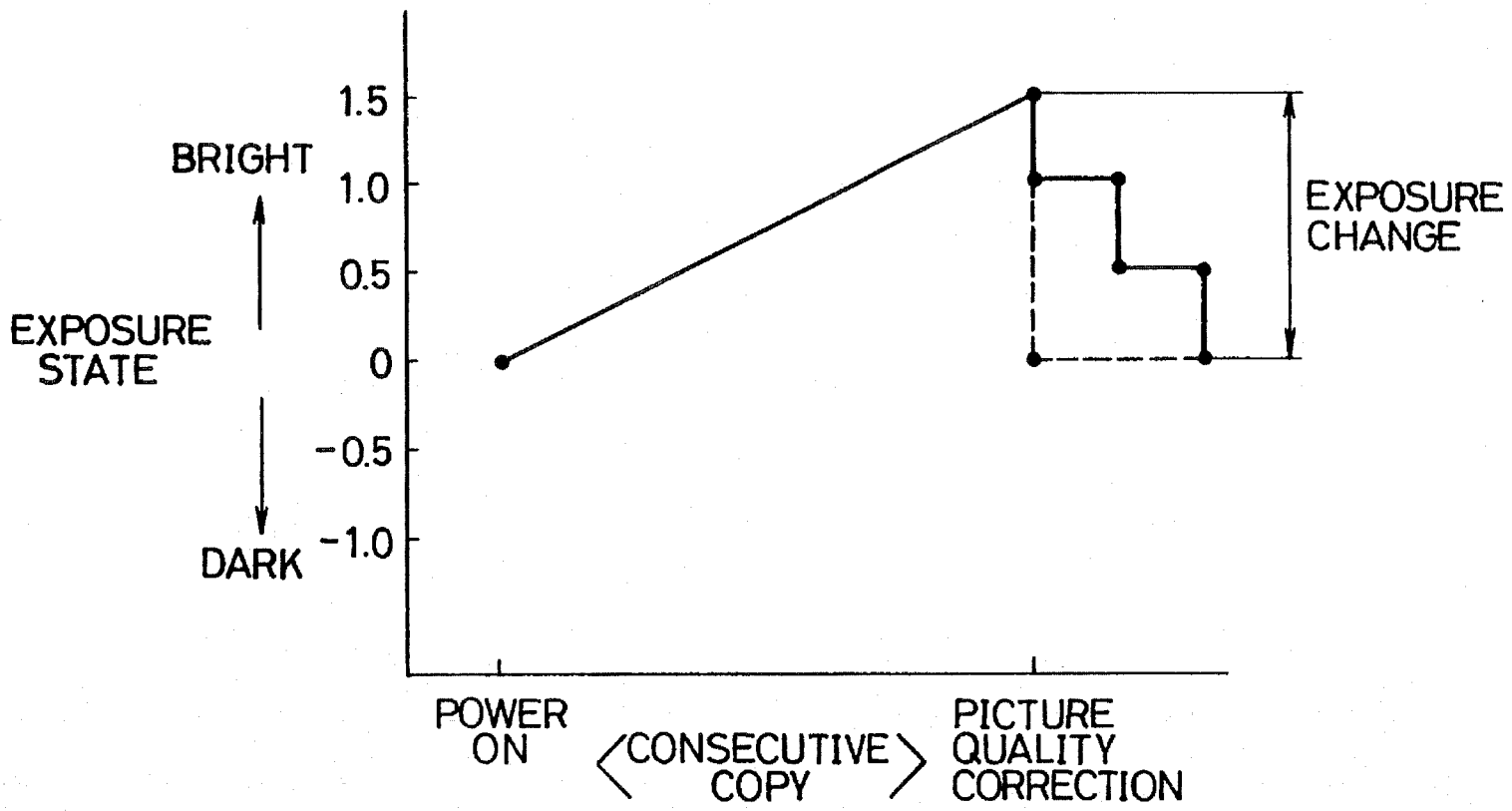
FIG. 5 is an explanatory diagram showing a state where the process control is carried out step by step in the process control apparatus.

More specifically, as shown in FIG. 5, when the copying operation is carried out with respect to a plurality of sheets, the temperature inside the copying machine rises so that the picture image density gradually becomes bright. For example, in a case where the exposure division reaches 1.5, when the picture quality is corrected, the following is stepwise carried out: (1) the exposure state is first control led so as to be the exposure division of 1.0 at the first stage; (2) the exposure state is controlled so as to be the exposure division of 0.5 at the second stage; and (3) the exposure state is controlled so as to be the exposure division of 0.0, which is suitable for the exposure operation, at the third stage (see the solid line of FIG. 5).

As mentioned above, according to the copying machine of the present embodiment, the CPU 19 as information processing means forms a toner patch between every two toner images for copying operation, and controls each section of the copying processes upon receipt of the plurality of the detected results from the optical sensor 16. Since the process controls are carried out by making use of the period of time between every two toner image formings for copying operation, it can be avoided that the job efficiency is reduced, i.e., the job efficiency deteriorates. Since the control data obtained from the toner patches is soon used for the toner image formation for copying operation, the process control improves in accuracy.

Since the CPU 19 as information processing means is arranged so as to stepwise control each section of the electrophotographic process when a plurality of toner images for the picture image is formed, the great change (see the broken lines of FIG. 5) of the picture quality can be avoided.

According to the arrangement, the accuracy of the process control improves, thereby achieving the optimization of the picture image formation, and the great change of the picture quality can be avoided, thereby reducing the user's feeling of discrepancy for the copying machine.

Figure 6:
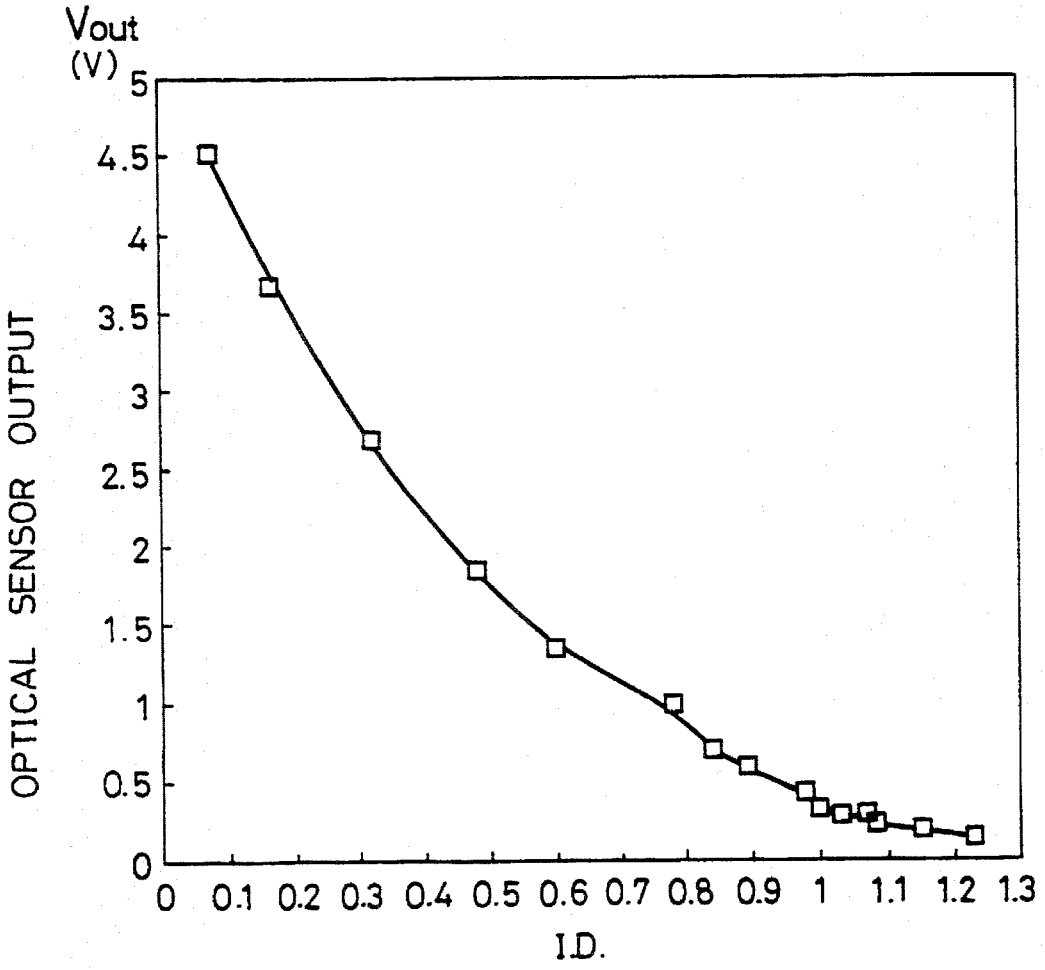
FIG. 6 is an explanatory diagram showing a characteristic indicative of a relation between a copied picture image density (ID) of the copying machine and an output of the optical sensor.
Figures 7A, 7B, 7C, 7D, 7E, 7F:
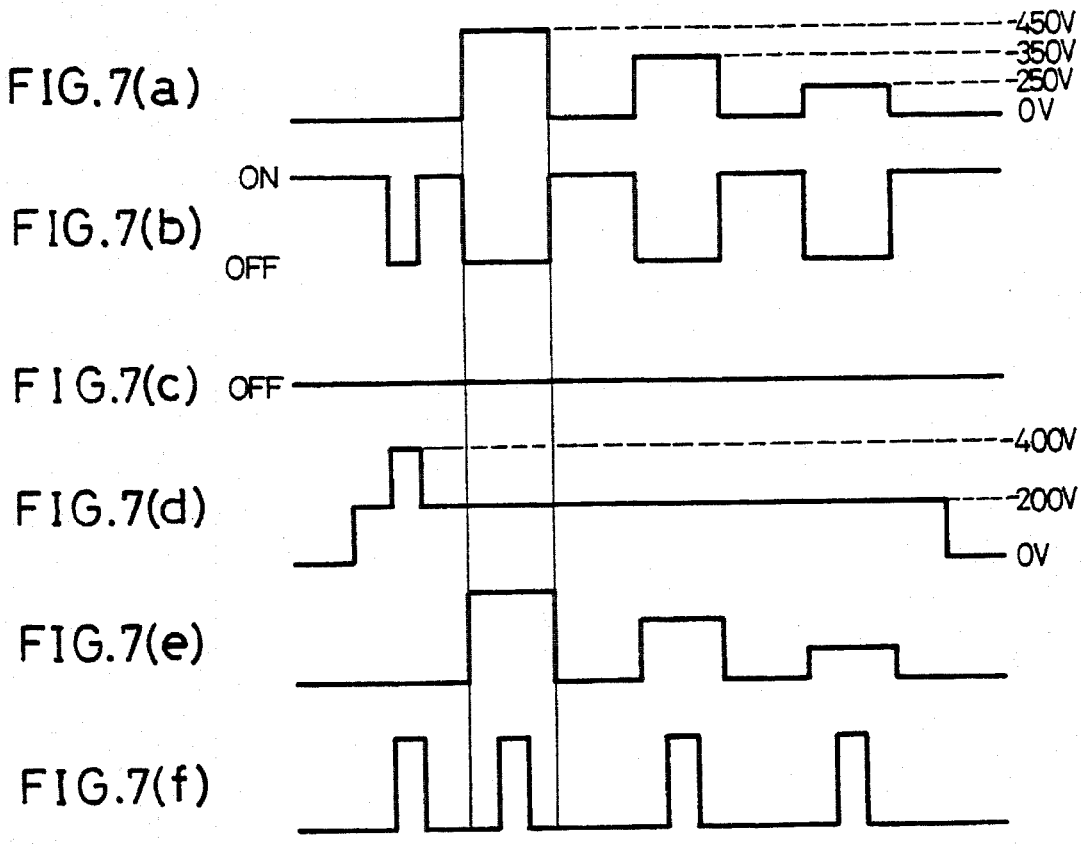
FIGS. 7(*a*), 7(*b*), 7(*c*), 7(*d*), 7(*e*), and 7(*f*) are time charts showing respectively a process control for detecting base density of a photoreceptor drum by increasing a developing bias voltage in a copying machine having a process control apparatus of another embodiment in accordance with the present invention.

The following description deals with the second embodiment in accordance with the present invention with reference to FIGS. 3, 6, and 7. Note that the same reference numerals are given to members having similar functions to the foregoing first embodiment and the description is omitted.

A CPU 19 of the present embodiment, provided as a control device of a process control section 15, has the function of means for controlling a developing voltage by which the developing bias voltage during a density detection of an optical sensor 19 with respect to an outer surface of a drum base is changed compared to that of during a density detection of a toner patch. For example, by the function it is avoidable that the developing bias voltage is controlled so that the toner is attracted by the residual electric potential of the bright section on a photoreceptor drum 1 which is generated during the exposure operation.

Note that the drum base shows the state where no toner adheres to the surface of a non-exposed area when a developing unit 9 passes by the non-exposed area of the photoreceptor drum 1.

An object of the developing voltage control means is to improve in the accuracy of the optical sensor 16 which detects the optical density of the toner patch. More specifically, the present embodiment is arranged such that in the process control, the density of the drum base is detected prior to the detection of the density of the toner patch formed on the photoreceptor drum 1.

When the density of the toner patch is identified, the value, which is obtained by dividing the detected density of the toner patch by the detected density of the drum base, is calculated as an optical sensor output. As shown in FIG. 6, the grid voltage, developing bias voltage and the like are controlled in accordance with the density of a picture image corresponding to the optical sensor output at a room temperature of 25° C. for example so as to correct the picture quality.

However, under the low temperature circumstance, the developing operation is carried out with the ordinary developing bias voltage of −200 V, and thereafter the density of the drum base is detected. When the developing of the toner patch is also developed by the same developing bias voltage of −200 V, the detected values of the optical sensor 16 take 0.35, 0.62, and 1.00 for the grid voltages −450 V, −350 V, −250 V respectively (see Table 1 as comparative example 1).

When forecasting the copying density from FIG. 6 based on the detected values, the forecasted values are 1.00, 0.87, and 0.77 respectively. However, these forecasted values have respective differences of 0.20, 0.16, and 0.11 when compared to the actual copying density. If the process control of the copying operation is carried out in accordance with the forecasted copying density, the picture image can not be corrected with accuracy. This is because the toner adheres to a white surface area due to the residual electric potential of the bright section which is induced under the low temperature circumstance, thereby causing the output of the bare surface to become great.

However, according to the present embodiment, in a case where the density of the drum base is detected, the developing bias voltage is changed from the ordinary temperature −200 V to −400 V for example when a temperature sensor 33 detects that the internal temperature is not higher than a predetermined temperature, i.e., by increasing the developing bias voltage in its absolute value, the bare surface output can be detected without adhering of the toner of the developing unit 9 to the white surface area of the photoreceptor drum 1.

Accordingly, as shown in Table 2, the detected values of the optical sensor 16 took 0.70, 1.07, and 1.21 for the respective grid voltages −450 V, −350 V, and −250 V. When forcasting the copying density from FIG. 6 based on the detected values, the forecasted values become 0.83, 0.75, and 0.67 respectively, these forecasted values having respective small differences of 0.03, 0.02, and 0.02 when compared to the actual copying density. Namely, when the process control of the copying operation is carried out in accordance with the forecasted copying density, the picture image can be corrected with accuracy.

The following description deals with the process of the optical density detection in accordance with the present embodiment with reference to the time chart of FIGS. 7(*a*) through 7(*f*).

First, under a condition where the grid voltage is 0 V, a blank lamp 8 is turned off (see FIG. 7(*b*)), and a copy lamp 4 is turned off, the developing bias voltage is changed from −200 V to −400 V, the density of the drum base is detected by the optical sensor 16. Then, different positions on the photoreceptor drum 1 are charged with respective different grid voltages −450 V, −350 V, and −250 V in this order (see FIG. 7(*a*)). The charged areas are not exposed because the copy lamp 4 is turned off (see FIG. 7(*c*)).

So, electrical charges remain on the charged areas due to the grid voltages. When the charged areas are developed by the constant developing bias voltage of −200 V (see FIG. 7(*d*)), three toner patches having respective different density are formed (see FIG. 7(*e*)). Then, each density detection of the detected toner patches by the optical sensor 16 is carried out in accordance with the detecting timing of FIG. 7(*f*), and thereafter the grid voltage, developing bias voltage and the like are controlled in accordance with the respective detected toner patches density so as to correct the picture quality. As mentioned above, under the low temperature circumstance, the residual electric charges on the photoreceptor drum 1 becomes great and the toner adheres to the photoreceptor drum 1 due to the residual electric charges, thereby causing the tendency that the detected density of the drum base becomes great. However, according to the process control apparatus of electrophotographic apparatus in accordance with the present embodiment, the developing voltage control means controls the developing bias voltage so as to be greater during detecting the density of the drum base more than during detecting of the density of the reference toner image, thereby avoiding the adhering of the toner to the bright section.

Accordingly, the increased component of the developing bias voltage erases the residual electrical charges on the photoreceptor drum 1. Since the the density of the drum base is detected with almost no toner which adheres to the photoreceptor drum 1, the density of the drum base is obtained with accuracy. So, the output of the optical sensor 16 becomes accurate, thereby improving in the accuracy of the process control.

The following description deals with the third embodiment in accordance with the present invention with reference to FIG. 3 and FIGS. 8 through 12. Note that the same reference numerals are given to members having similar functions to the foregoing first or second embodiment and the description is omitted.

In a copying machine of the present embodiment, as shown in FIG. 3, a CPU 19, provided as a control device of a process control section 15, judges whether or not the difference between a detected temperature of the foregoing temperature sensor 33 and the detected temperature during the previous process control is not less than a set value. If the difference is not less than the set value, the copying process is again controlled. Thus, the CPU 19 has a function of frequent control means. An object of the present embodiment is to make the timing of process control suitable by use of the temperature sensor 33 and frequent control means.

Figure 8:
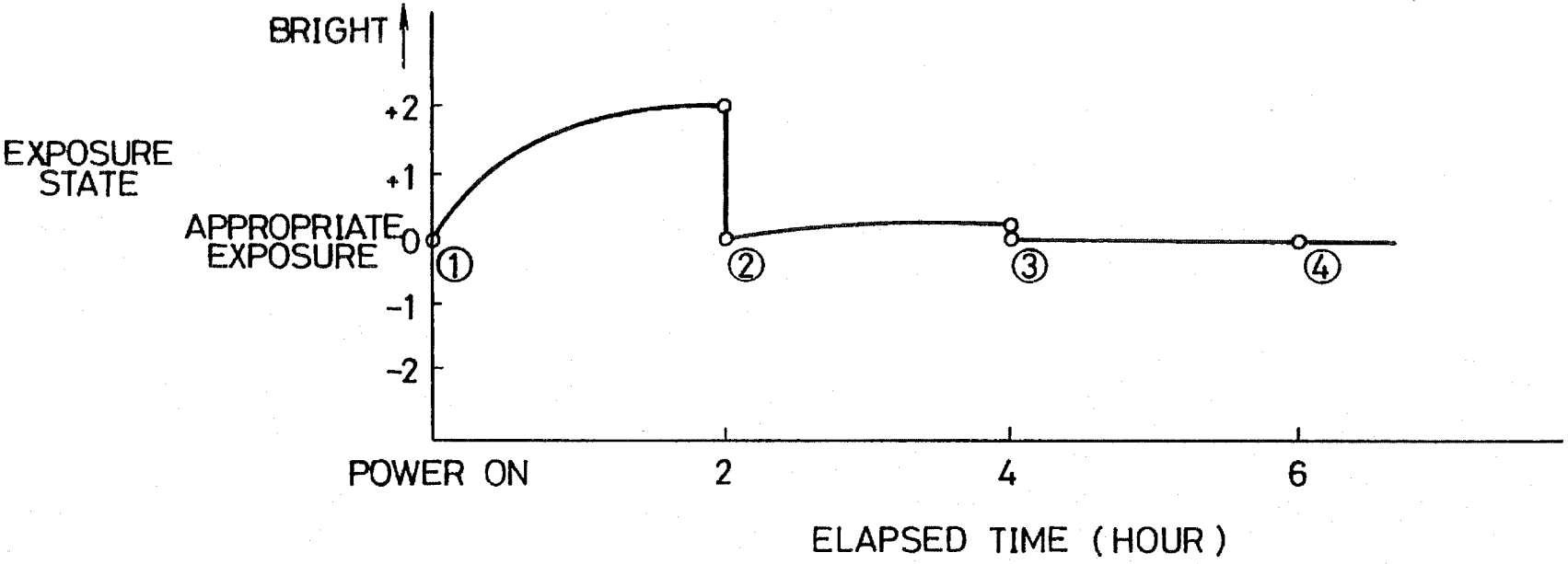
FIG. 8 is an explanatory diagram showing a state where the process control is carried out for every 2 hours in a process control apparatus of a comparative example.
Figure 9:
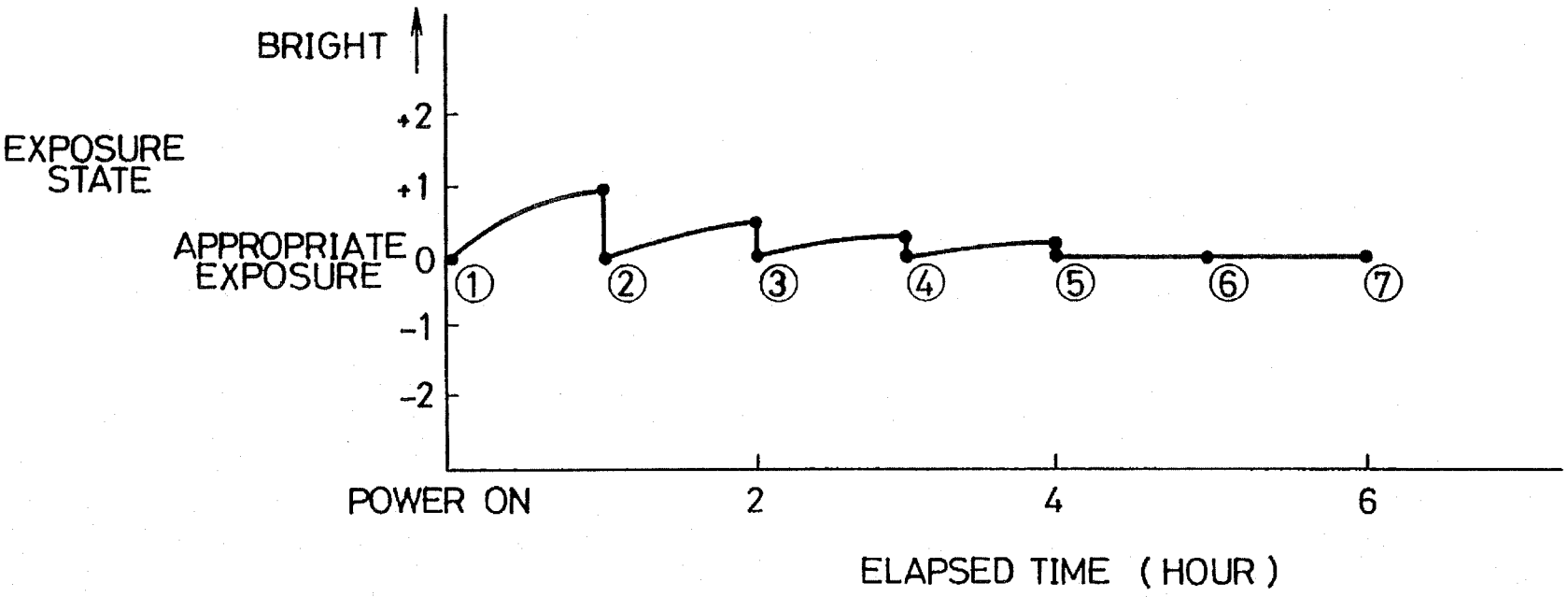
FIG. 9 is an explanatory diagram showing a state where the process control is carried out for every one hour in a process control apparatus of a comparative example.

More specifically, when the optimization of the copying process is carried out for every two hours irrespective of the temperature sensor 33, the maximum two exposure division occurs (see comparative example 1 of FIG. 8). This changed amount of the exposure state is great, so it is not preferable as the changing range of the picture quality of the copied picture image.

In order to solve the deficiency, when the optimization of the copying process is carried out for every one hour, the picture image is controlled within the changing range of maximum one exposure division (see comparative example 2 of FIG. 9), thereby improving in the accuracy of the optimization of the copying process. In contradiction thereto, total seven times of optimizations of the copying process were carried out. As a result, since one gram of toner is consumed for one time of optimization of the copying process, total seven grams of toner were consumed for seven times of optimizations of the copying process, thereby increasing the consumed amount of toner.

In contrast, according to the process control apparatus of electrophotographic apparatus of the present embodiment, when the temperature difference between an internal temperature T2 currently detected by the temperature sensor 33 and a detected internal temperature T1 during the previous process control becomes not less than a predetermined set value of 5° C. for example, the optimization of the copying process is carried out by the frequent control means.

Figure 10:
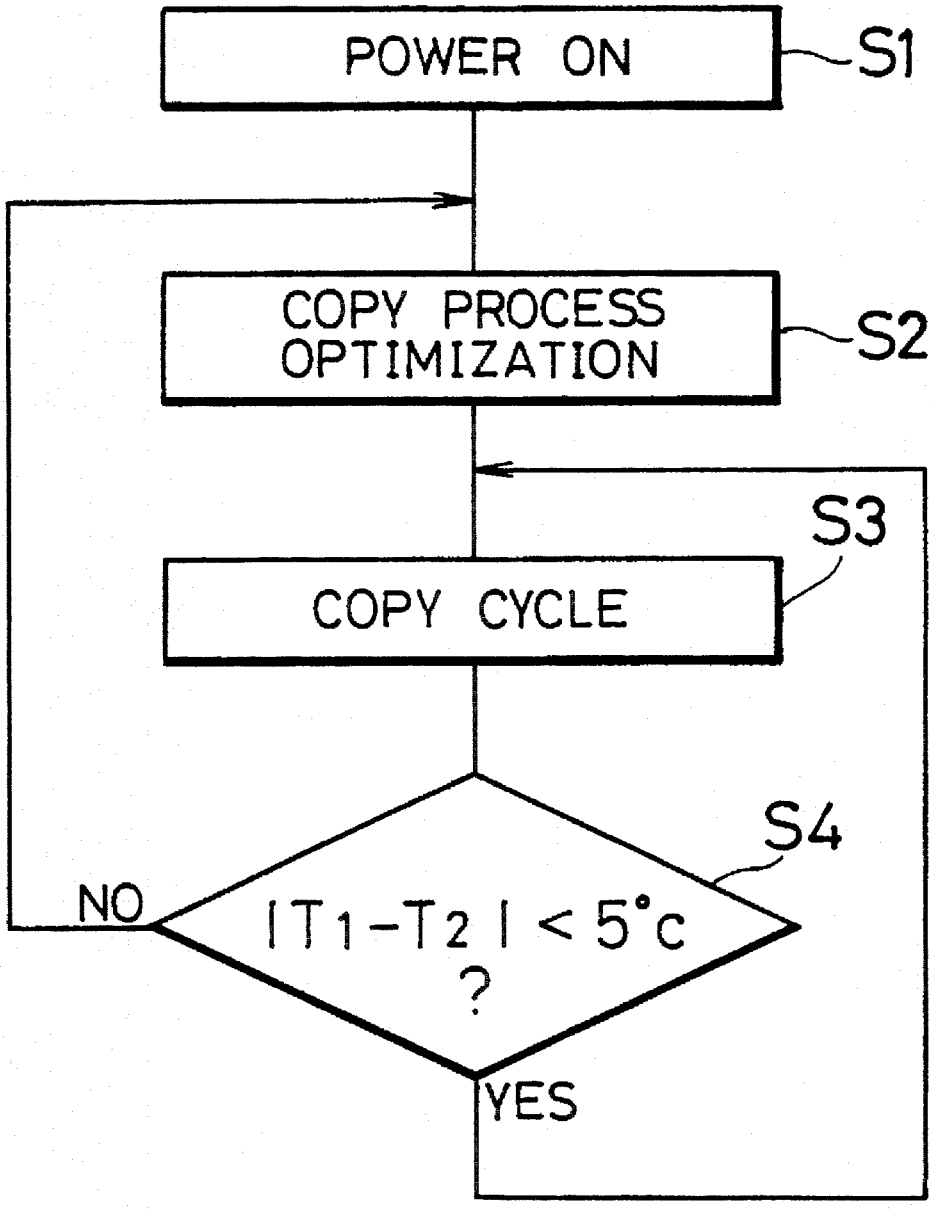
FIG. 10 is a flow chart showing a process control of a process control apparatus of a still another embodiment accordance with the present invention.

The following description deals with the controlling operations of the process control device of the copying machine with reference to the flow chart of FIG. 10.

First, when the main power source of the copying machine is turned on (S1), the temperature inside the copying machine is detected, thereafter the first copying process is optimized (S2). Thereafter, the copy cycle comes and the copying machine goes into a consecutive copying state or into a waiting state (S3). Next, the temperature sensor 33 detects the temperature inside the copying machine.

It is judged whether or not the temperature difference between a currently detected internal temperature T2 and a detected internal temperature T1 during the previous optimization of the copying process is not less than the predetermined set value of 5° C. for example (S4). If, in S4, the temperature difference between the current internal temperature T2 and the previous internal temperature T1 is not less than 5° C., the process returns to S2 so as to optimize the copying process. If, in S4, the temperature difference between the current internal temperature T2 and the previous internal temperature T1 is less than 5° C., the process returns to S3.

Figure 11:
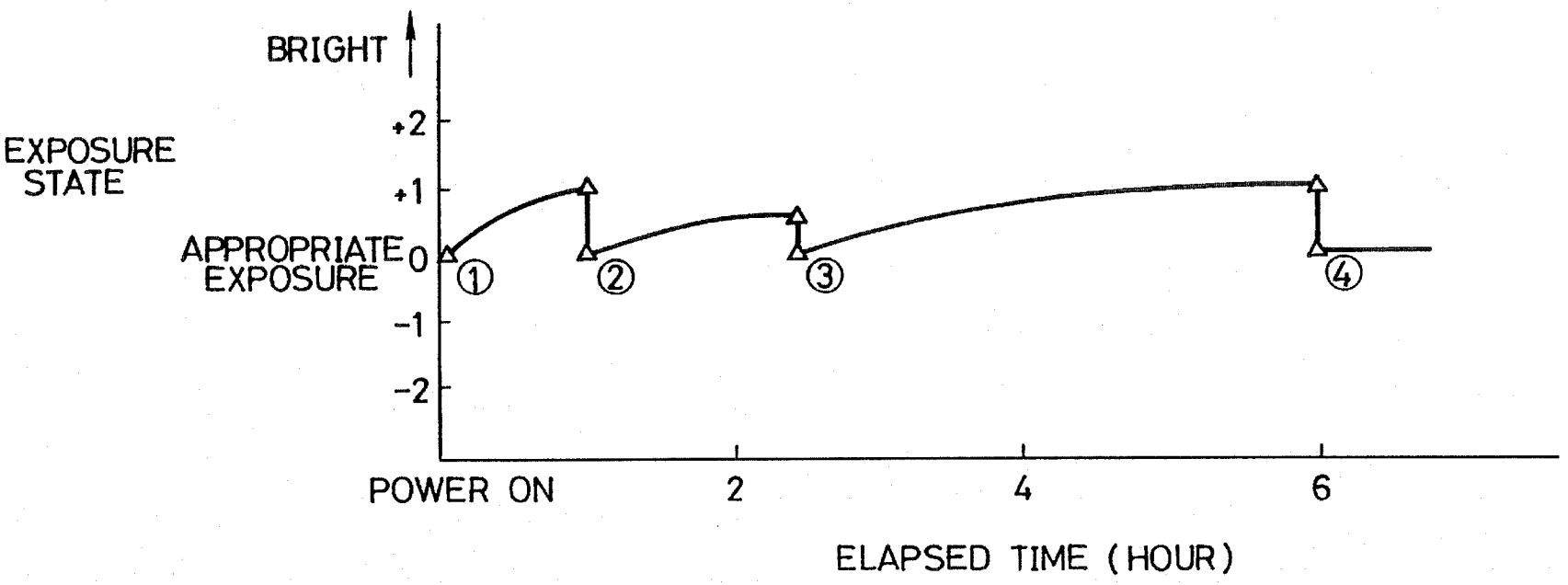
FIG. 11 is an explanatory diagram showing a process control in accordance with a temperature sensor of the process control apparatus.

When the copying machine is operated in accordance with the foregoing process control, as shown in FIG. 11 for example, the optimization of the copying process was carried out four times for six hours of one day including the optimization at the main power turn-on of the copying machine, and the exposure division fell within a range of maximum one from the appropriate exposure value.

Figure 12:
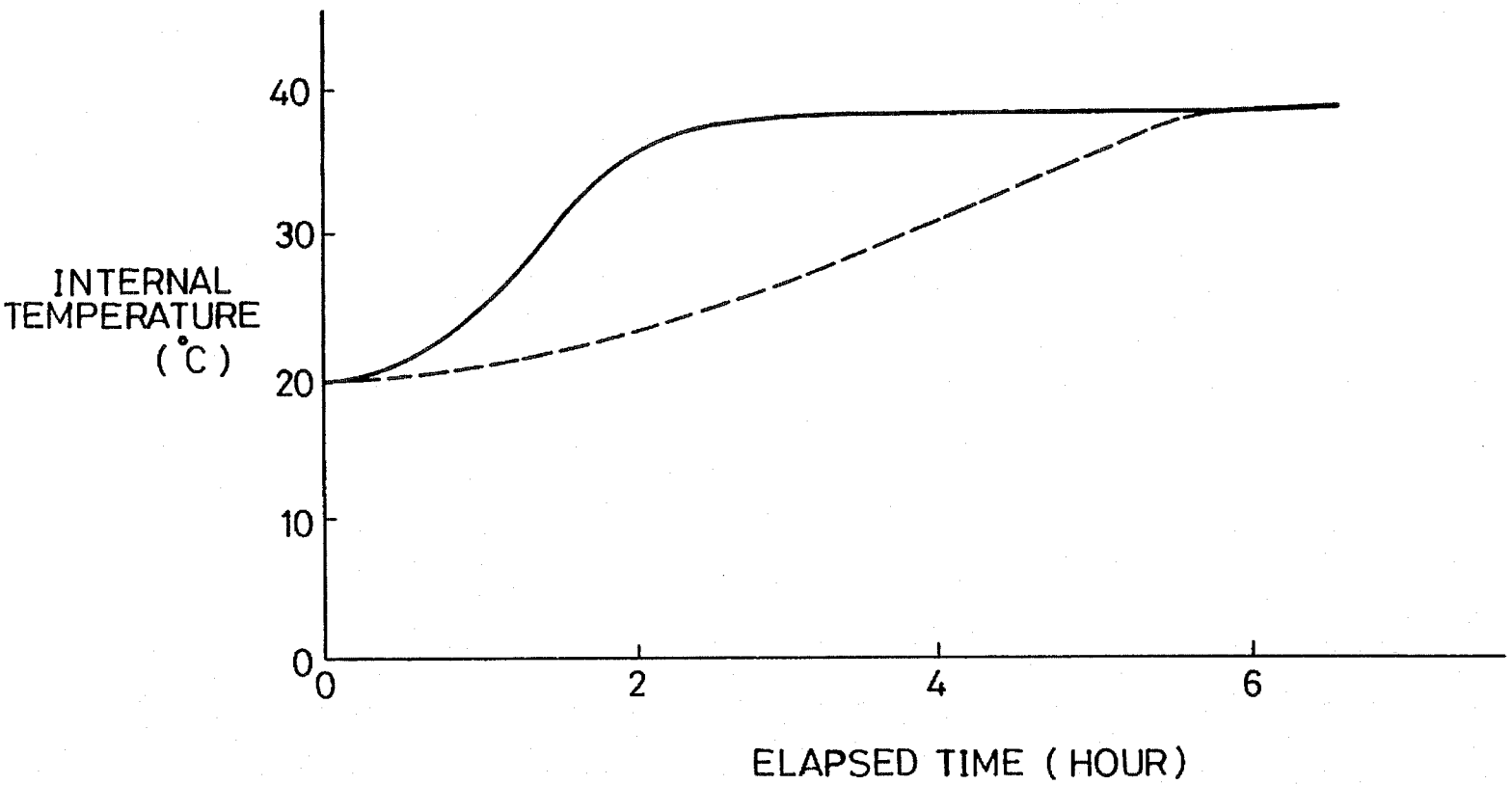
FIG. 12 is an explanatory diagram showing a characteristic indicative of a relation between a internal temperature of a copying machine having the process control apparatus and an elapsing time.

Note that when the internal temperature is assumed to be 20° C. for example at the main power turn-on of the copying machine, it reaches about 40° C. two hours later and thereafter becomes a steady state for the consecutive copying (see the solid line of FIG. 12), while it gradually rises up to 40° C. six hours later for the mode of leaving as it is (see the broken line of FIG. 12).

As mentioned above, according to the process control of the present embodiment, (1) the picture quality is controlled within the range of maximum one exposure division, thereby reducing the change of the picture quality more than the conventional case, and (2) the toner consumed amount is 4 grams for the optimization of the process, thereby ensuring that the toner consumed amount is reduced compared to the conventional case (see Table 3).

As mentioned above, according to the process control device of the copying machine in accordance with the present embodiment, the temperature sensor 33 is provided for detecting the temperature inside the copying machine, and the frequent control means judges whether or not the temperature difference between the internal temperature currently detected by the temperature sensor 33 and the detected internal temperature during the previous controlling of each section of the copying process is not less than the predetermined set value. With the arrangement, if not less than the predetermined set value, each section of the copying process is again controlled, thereby resulting in that the process control is carried out in correspondence with the temperature change in the copying machine.

So, the optimization of the process control can be achieved with small frequency and the great picture quality change can be avoided, thereby ensuring that the great toner consumed amount can be avoided, the process control improves in its accuracy, and the optimization for the picture image formation can be achieved.

Note that when the foregoing temperature sensor 33 is adapted to the second embodiment, it is possible that the developing bias voltage is controlled by the developing voltage control means in accordance with an internal temperature detected inside the copying machine. For example, it is possible that when the detected temperature inside the copying machine is not more than for example 15° C., the developing bias voltage is controlled so as to increase the developing bias voltage more than that of during detecting of the density of the reference toner image when the density of the drum base which is a photoreceptor drum 1 whereon no toner image is formed is detected.

Since the density of the drum base is accurately detected even under the low temperature circumstance, the detected density based on the output of the optical sensor 16 is more accurate, thereby enabling to further improve the accuracy of the process control.

Figure 13:
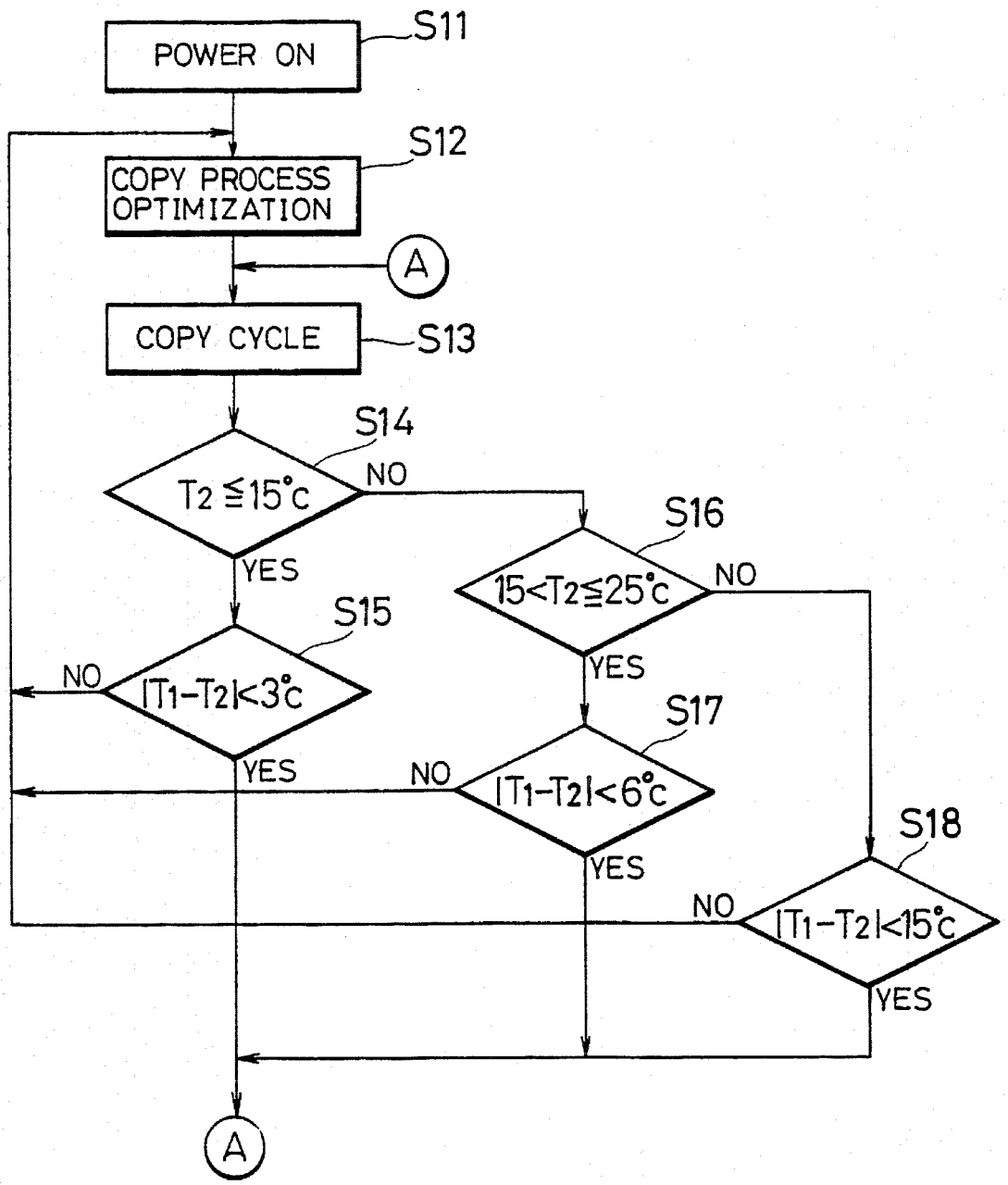
FIG. 13 is a flow chart showing a process control of a process control apparatus of another embodiment in accordance with the present invention.
Figure 14:
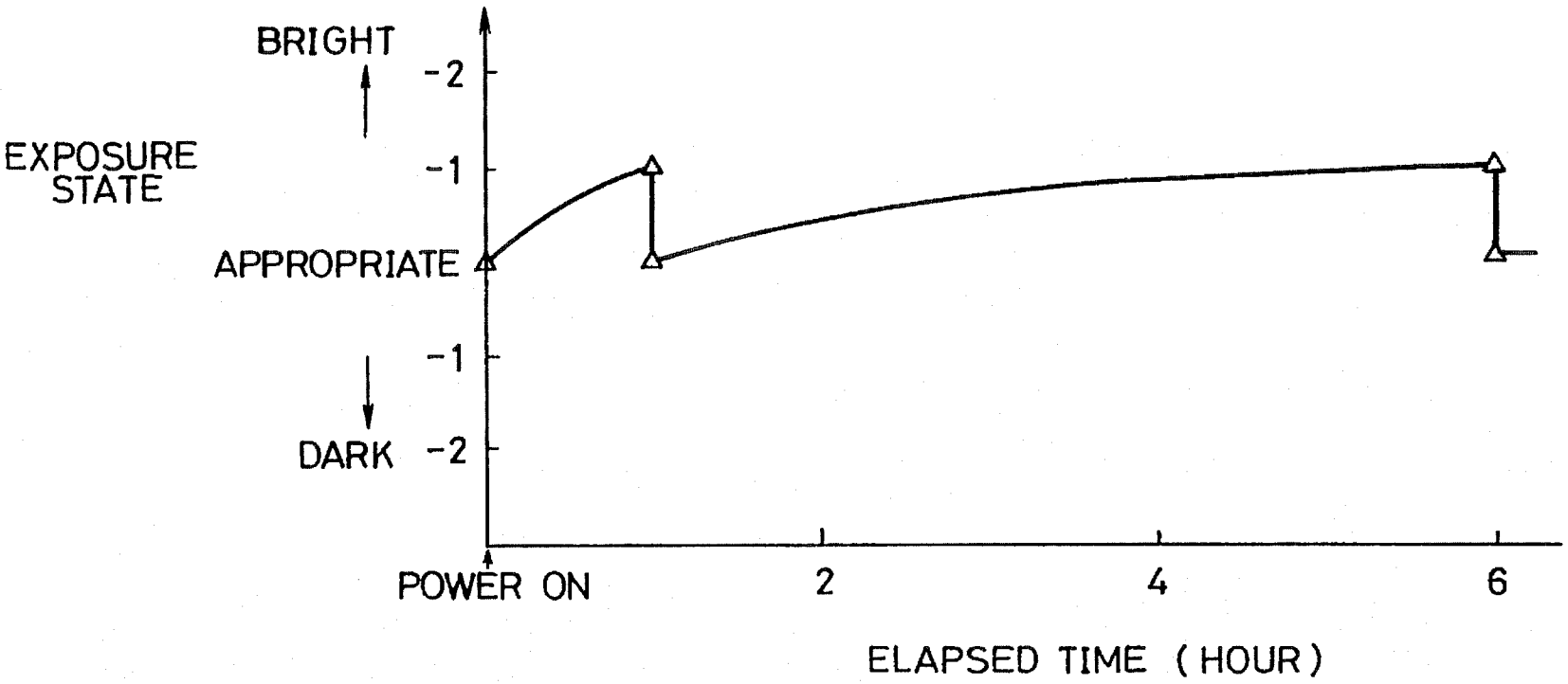
FIG. 14 is an explanatory diagram showing a process control in accordance with a temperature sensor of the process control apparatus.
Figures 15A, 15B, 15C, 15D, 15E, 15F:
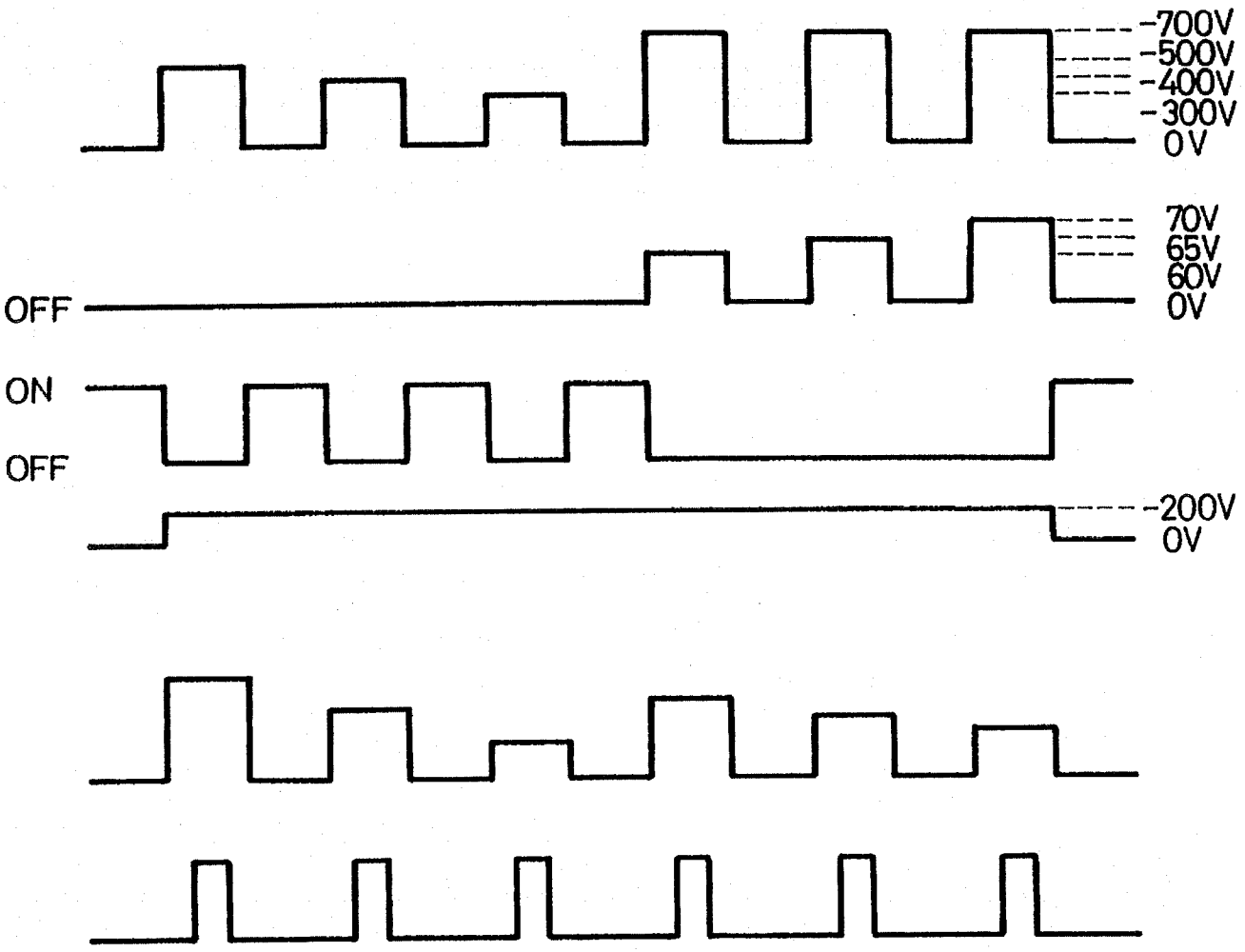
FIGS. 15(*a*), 15(*b*), 15(*c*), 15(*d*), 15(*e*), and 15(*f*) are time charts showing respectively a process control for forming a plurality of toner patches in a conventional copying machine.

The following description deals with the fourth embodiment in accordance with the present invention with reference to FIGS. 3, 13, and 14. Note that the same reference numerals are given to members having similar functions to the foregoing first embodiment and the description is omitted.

In a process control apparatus of electrophotographic apparatus in accordance with the present embodiment, a CPU 19 of the foregoing embodiment 3 has a further function of set temperature changing means by which a set value which determines whether or not the frequent control means should be operated is changed in accordance with a temperature detected by a temperature sensor 33.

By the way, the sensitivity of a photoreceptor drum 1 becomes worse under the low temperature circumstance, and becomes better in accordance with the temperature rise. The photoreceptor drum 1 has also a characteristic wherein the changing rate of the improving sensitivity due to the temperature rise becomes small as the temperature rises.

The above-mentioned arrangement has the set temperature changing means for changing the set value of the foregoing embodiment 3 in accordance with the temperature detected by the temperature sensor 33 as internal temperature detecting means. The temperature rises inside the electrophotographic apparatus affects on the process control. However, according to the present embodiment, the process control can be carried out in accordance with the changing of the sensitivity of the photoreceptor drum 1 even though the temperature inside the electrophotographic apparatus rises.

More specifically, since the sensitivity change of the photoreceptor drum 1 due to the temperature rise is great under the low temperature circumstance, the execution of the process control can be frequently done by setting the set value small, while, under high temperature circumstance of the case where the temperature rises up to the ordinary temperatures or to 40° C., since the sensitivity change of the photoreceptor drum 1 due to the temperature rise is small, the execution of the process control can not be frequently done by setting the set value great.

With the arrangement, though the sensitivity change of the photoreceptor drum 1 due to the temperature rise inside the copying machine is small, the unnecessary execution of the process control, which is carried out when the temperature change inside the copying machine is not less than a predetermined value, can be omitted.

As a result, according to the present arrangements it can be avoided that the copying picture quality deteriorates by increasing of the process control execution. So, the optimization of the process control can be achieved like the foregoing embodiment 3, and the unnecessary execution of the process control can be omitted while keeping the copying picture quality at high temperatures or at the ordinary temperatures after the temperature rise, thereby ensuring that the toner consumed amount for the process control is reduced and that each section for the process control has a long life.

The following searched results deal with the relation between the exposure state and the elapsing time (about six hours) by the use of a copying machine having the foregoing arrangement. The searched results are shown in FIG. 14. In such case, the maximum picture quality change in such exposure states and the toner consumed amount during the process control are also studied. The results are indicated in Table 4. Note that the comparative examples 1 and 2 of the foregoing embodiment 3 are also indicated for comparison purpose.

The present embodiment as shown in FIG. 14, can reduce the execution number of the process control while keeping the copying picture quality, and can also reduce, as shown in Table 4, the toner consumed amount for the process control. Moreover, the execution number of the process control during each copying operation of the electrophotographic apparatus can be reduced so that the waiting time for the copying operation is reduced, thereby further improving the copying efficiency and thereby enabling that the total required time for copying a plurality of copying operations is reduced.

The process control apparatus of electrophotographic apparatus of the present invention, as mentioned above, is provided with information processing means for forming a reference toner image between every two toner images for a picture image, and for controlling each section of the electrophotographic process upon receipt of a plurality of the detected results from the density detecting means.

Therefore, since the process control is carried out by making use of the period of time between every two toner image formations for the picture image formation, it can be avoided that the job efficiency deteriorates. Since the control data obtained from the toner patches is soon used for the toner image formation for the picture image, the process control improves in accuracy.

Another process control apparatus of electrophotographic apparatus of the present invention, as mentioned above, is arranged such that the information processing means stepwise controls each section of the electrophotographic process during controlling of each section of the electrophotographic process.

Therefore, the great change in the picture quality during the picture image formations can be avoided. So, the process control improves in accuracy and the optimization of the picture image formation can be achieved.

Still another process control apparatus of electrophotographic apparatus of the present invention, as mentioned above, is provided with internal temperature detecting means for detecting the temperature inside the electrophotographic apparatus and frequency control means for controlling again each section of the electrophotographic process when the temperature difference between an internal temperature currently detected by the internal temperature detecting means and a detected internal temperature during the previous process control becomes not less than a predetermined set value.

Therefore, the process control is carried out in accordance with the temperature change inside the electrophotographic apparatus. So, the process control can be carried out not so often, and the great change of the picture quality can be avoided. Accordingly, it can be avoided that the toner consumed amount become great, and the process control improves in accuracy, thereby enabling to optimize the picture image formation.

Further process control apparatus of electrophotographic apparatus of the present invention, as mentioned above, is provided with developing bias voltage control means for changing the developing bias voltage, which prevents the toner from being attracted by the residual electric potential of the bright section on a photoreceptor which is generated after the exposure operation, so as to be different from that of during detecting of the density of the reference toner image when density detecting means detects the density of the photoreceptor base.

Therefore, it is possible to erase the residual electric potential on the photoreceptor by the changed developing bias voltage, thereby enabling to detect the density of the photoreceptor base with adhering of almost no toner to the photoreceptor. So, since the density of the photoreceptor base is detected with accuracy, the output from the density detecting means becomes accurate, thereby ensuring that the process control improves in accuracy.

Still further process control apparatus electrophotographic apparatus of the present invention, as mentioned above, is further provided with set value changing means for changing the set value in accordance with the temperature detected by the internal temperature detecting means.

Therefore, the optimization of the process control can be achieved, and the unnecessary execution of the process control can be omitted under the circumstance such as at high temperatures or at the ordinary temperatures after the temperature rise, thereby enabling to reduce the toner consumed amount for the process control.

There are described above novel features which the skilled man will appreciate give rise to advantages. These are each independent aspects of the invention to be covered by the present application, irrespective of whether or not they are included within the scope of the following claims.

TABLE 1

| Grid Volt. (V) | Detected Toner Image/ Bare Surf. Output | Forecasted Copy Dens. | Actual Dens. | Difference |
|---|---|---|---|---|
| −450 | 0.35 | 1.00 | 0.80 | 0.20 |
| −350 | 1.62 | 0.87 | 0.73 | 0.16 |
| −250 | 1.00 | 0.77 | 0.65 | 0.11 |

TABLE 2

| Grid Volt. (V) | Detected Toner Image/ Bare Surf. Output | Forecasted Copy Dens. | Actual Dens. | Difference |
|---|---|---|---|---|
| −450 | 0.70 | 0.83 | 0.80 | 0.03 |
| −350 | 1.07 | 0.75 | 0.73 | 0.02 |
| −250 | 1.21 | 0.67 | 0.65 | 0.02 |

TABLE 3

| | Max. Picture Quality Change | Toner Consumed Amount |
|---|---|---|
| 3rd Embodiment | 1 Division | 4 g |
| Comparative Example 1 | 2 Division | 4 g |
| Comparative Example 2 | 1 Division | 7 g |

TABLE 4

| | Max. Picture Quality Change | Toner Consumed Amount |
|---|---|---|
| 4th Embodiment | 1 Division | 2 g |
| Comparative Example 1 | 2 Division | 4 g |
| Comparative Example 2 | 1 Division | 7 g |

What is claimed is:

1. A process control apparatus of electrophotographic apparatus comprising:

density detecting means for optically detecting density of a reference toner image on a photoreceptor;

means for judging whether or not said density detecting means has detected the density by a predetermined number of times; and information processing means for forming a reference toner image between every two toner images for a picture image formation, and for controlling each section of an electrophotographic process in response to said judging means so as to stabilize picture quality of a formed picture image.

2. The process control apparatus of electrophotographic apparatus as set forth in claim 1, wherein the reference toner image is a toner patch, and each section of the electrophotographic process is controlled by making use of a period of time for each toner image formation.

3. The process control apparatus of electrophotographic apparatus as set forth in claim 2, wherein said information processing means includes:

charge control means for controlling a charge voltage which is applied onto said photoreceptor; and means for forming a toner patch on said photoreceptor by developing a latent image having an electric charge amount varying depending on the charge voltage while applying a predetermined developing bias voltage, wherein said charge control means charges said photoreceptor by a different charge voltage so that each toner patch has a different toner density to be visualized.

4. The process control apparatus of electrophotographic apparatus as set forth in claim 3, wherein said density detecting means includes a case having an outer surface, the outer surface having a section for attaching a light generating diode and a photo-transistor located proximate to each other.

5. The process control apparatus of electrophotographic apparatus as set forth in claim 1, wherein said information processing means is arranged so as to stepwise control a degree of an exposure during controlling each section of the electrophotographic process, thereby obtaining an optimum exposure state.

6. A process control apparatus of electrophotographic apparatus comprising:

density detecting means for optically detecting density of a reference toner image on a photoceptor;

residual electric potential erase means for erasing a residual electric potential on said photoreceptor;

temperature detecting means for detecting a temperature inside said electrophotographic apparatus; and means for controlling said density detecting means and residual electric potential erase means so that density of the reference toner image is detected after erasing the residual electric potential on said photoreceptor when the detected temperature is not higher than a predetermined temperature, whereby density of the reference toner image is accurately detected and a picture quality correction is carried out in accordance with density of the reference toner image.

7. The process control apparatus of a electrophotographic apparatus as set forth in claim 6, wherein said residual electric potential erase means includes means for adjusting a developing bias voltage so that the developing bias voltage increases.

8. The process control apparatus of electrophotographic apparatus as set forth in claim 6, wherein the predetermined temperature is 15° C.

9. A process control apparatus of electrophotographic apparatus comprising:

density detecting means for optically detecting density of a reference toner image on a photoreceptor;

temperature detecting means for detecting a temperature inside said electrophotographic apparatus; and means for judging whether or not a temperature difference between a temperature currently detected by said temperature detecting means and a detected temperature during controlling of each section of a previous electrophotographic process becomes not less than a predetermined temperature difference;

control means for controlling again each section of the electrophotographic process so as to stabilize a picture quality of a formed picture image when the temperature difference is not less than the predetermined temperature difference.

10. The process control apparatus of electrophotographic apparatus as set forth in claim 9, wherein the predetermined temperature difference is 5° C.

11. A process control apparatus of electrophotographic apparatus comprising:

density detecting means for optically detecting density of a reference toner image on a photoreceptor, and for outputting as a detected result a value which is obtained by dividing detected density of the reference toner image by detected density of a photoreceptor base detected by said density detecting means; and developing bias voltage control means for changing a developing bias voltage, which prevents a toner from being attracted by a residual electric potential generated on a bright section on said photoreceptor after an exposure operation, said developing bias voltage being changed to be differed from that during detecting of the density of the reference toner image when said density detecting means detects the density of the photoreceptor base, whereby the density of the reference toner image is accurately detected and a picture quality correction is carried out in accordance with the detected result.

12. A process control apparatus of electrophotographic apparatus comprising:

density detecting means for optically detecting density of a reference toner image on a photoreceptor;

temperature detecting means for detecting a temperature inside said electrophotographic apparatus; and means for comparing (1) a temperature difference between a temperature currently detected by said temperature detecting means and a detected temperature during controlling of each section of a previous electrophotographic process with (2) a set reference temperature difference;

reference temperature changing means for changing the reference temperature difference in response to said temperature detecting means;

control means for controlling again each section of the electrophotographic process so as to stabilize a picture quality of a formed picture image when the detected temperature difference is not less than the reference temperature difference.

13. The process control apparatus of electrophotographic apparatus as set forth in claim 12, wherein said reference temperature changing means set the reference temperature difference small at low temperatures while set great at high temperatures.

14. The process control apparatus of electrophotographic apparatus as set forth in claim 1, wherein said electrophotographic apparatus is a copying machine.

15. The process control apparatus of electrophotographic apparatus as set forth in claim 4, wherein said electrophotographic apparatus is a copying machine.

16. The process control apparatus of electrophotographic apparatus as set forth in claim 6, wherein said electrophotographic apparatus is a copying machine.

17. The process control apparatus of electrophotographic apparatus as set forth in claim 9, wherein said electrophotographic apparatus is a copying machine.

18. The process control apparatus of electrophotographic apparatus as set forth in claim 11, wherein said electrophotographic apparatus is a copying machine.

19. The process control apparatus of electrophotographic apparatus as set forth in claim 12, wherein said electrophotographic apparatus is a copying machine.

20. A process control apparatus of electrophotographic apparatus comprising:

temperature detecting means for detecting a temperature inside said electrophotographic apparatus;

density detecting means for optically detecting respective density of a reference toner image on a photoreceptor and density of a photoreceptor base, and for outputting as a detected result a value which is obtained by dividing detected density of the reference toner image by detected density of the photoreceptor base; and developing bias voltage control means for controlling a developing bias voltage, in a case where the temperature detected by said temperature detecting means is not more than a predetermined temperature, so that the developing bias voltage during detection of the density of the photoreceptor base becomes greater than that during detection of the density of the reference toner image, whereby a toner is prevented from being attracted by a residual electric potential of a bright section on said photoreceptor and the density of the reference toner image is accurately detected so that a picture quality correction is carried out in accordance with the detected result of said density detecting means, the residual electric potential being generated after an exposure operation.

* * * * *